US006397561B1

(12) United States Patent
Matthews

(10) Patent No.: US 6,397,561 B1
(45) Date of Patent: Jun. 4, 2002

(54) TRANSVERSE DIRECTION ZIPPER WITH EDGES UNSECURED

(75) Inventor: David J. Matthews, Gilman, IL (US)

(73) Assignee: Illinois Tool Works Inc., Glenview, IL (US)

( * ) Notice: Subject to any disclaimer, the term of this patent is extended or adjusted under 35 U.S.C. 154(b) by 35 days.

(21) Appl. No.: 09/589,491

(22) Filed: Jun. 7, 2000

(51) Int. Cl.[7] ..... B65B 61/18

(52) U.S. Cl. ..... 53/412; 53/417; 53/133.4; 53/139.2; 53/138.7; 493/213; 493/927

(58) Field of Search ..... 53/412, 417, 419, 53/94, 138.3, 138.7, 139.2, 550, 133.4; 493/213, 927

(56) References Cited

U.S. PATENT DOCUMENTS 3,098,601 A * 7/1963 Anderson et al.
5,557,907 A * 9/1996 Malin et al.
6,017,412 A * 1/2000 Van Erden et al. ..... 53/139.2
6,032,437 A * 3/2000 Bois ..... 53/139.2
6,131,374 A * 10/2000 Bois ..... 53/139.2

* cited by examiner

*Primary Examiner*—Rinaldi I. Rada
*Assistant Examiner*—Sameh Tawfik
(74) *Attorney, Agent, or Firm*—Pitney, Hardin, Kipp & Szuch LLP

(57) ABSTRACT

In a form fill and seal apparatus, a film is provided with a zipper oriented transverse to the direction of travel of the film. The zipper includes a central area which is secured to the film. However, the zipper further includes outer areas which are free of attachment to the film prior to the film being turned down by the forming collar of the filling tube.

5 Claims, 3 Drawing Sheets

TRANSVERSE DIRECTION ZIPPER WITH EDGES UNSECURED

BACKGROUND OF THE INVENTION

1. Field of the Invention

This invention pertains to the attachment of the zipper in a direction transverse to the film in a form fill and seal machine, wherein the edges of the zipper are not attached to the film prior to the film turning down from the forming collar.

2. Description of the Prior Art

In the prior art of a form fill and seal (FFS) method and apparatus, it is known to attach the zipper in a transverse direction prior to the film turning down from the forming collar. However, there is a tendency for twisting and tension of the zipper as the zipper makes the drastic change of direction from flat to conforming to the diameter of the fill tube as the film turns down from the forming collar. This can result in degraded alignment of the zipper. These deficiencies of the prior art are illustrated in FIGS. 2A and 3A. Related prior art includes U.S. Pat. No. 6,017,412 entitled "Method for Attaching Reclosable Zipper Strip Transversely to Thermoplastic Film Material" issued on Jan. 25, 2000 to Van Erden et al. and U.S. patent application Ser. No. 09/234,174 entitled "Transverse Direction Zipper Attaching Apparatus and Method" filed on Jan. 19, 1999.

OBJECTS AND SUMMARY OF THE INVENTION

It is therefore an object of the present invention to reduce the twisting and tension of the transverse directed zipper in a form fill and seal method and apparatus as the film turns down from the forming collar.

It is therefore a further object of the present invention to reduce the twisting and tension of the transverse directed zipper in a form fill and seal method and apparatus as the zipper on the film makes the change of direction from flat to conforming to the diameter of the fill tube.

It is therefore a still further object of the present invention to provide for improved alignment of the zipper in a form fill and seal apparatus.

These and other objects are attained by securing the zipper transversely to the film at a central portion of the zipper while leaving the ends of the zipper free prior to turning the film down from the forming collar and making the change of direction from flat to conforming to the diameter of the fill tube. This allows the zipper to remain in a more natural or relaxed shape during this transition providing for improved alignment of the zipper.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
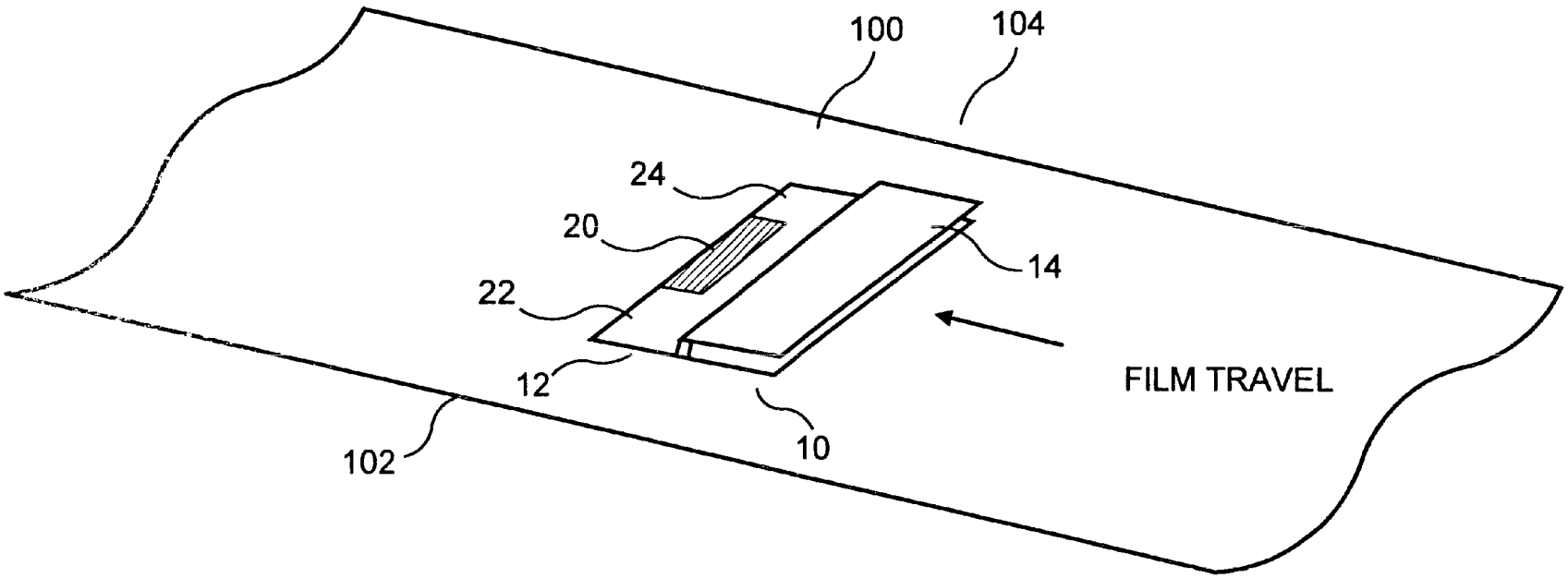
FIG. 1 is a perspective view of the film and the zipper of the present invention in the flat configuration prior to being turned down by the forming collar of a form fill and seal apparatus.
Figure 2B:
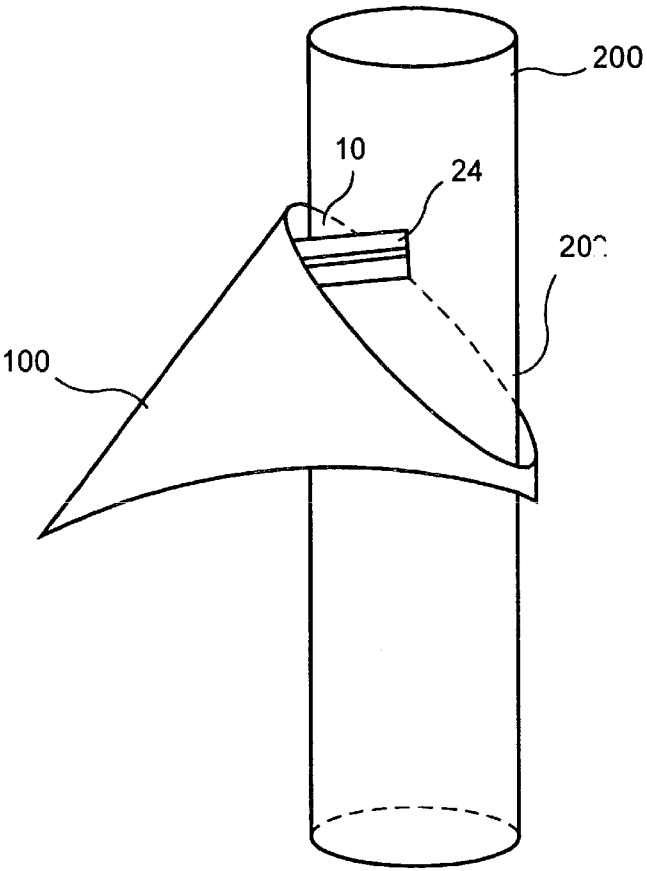
FIG. 2B is a side perspective view of the film and zipper of the present invention being turned down by the forming collar of a form fill and seal apparatus.
Figure 2A:
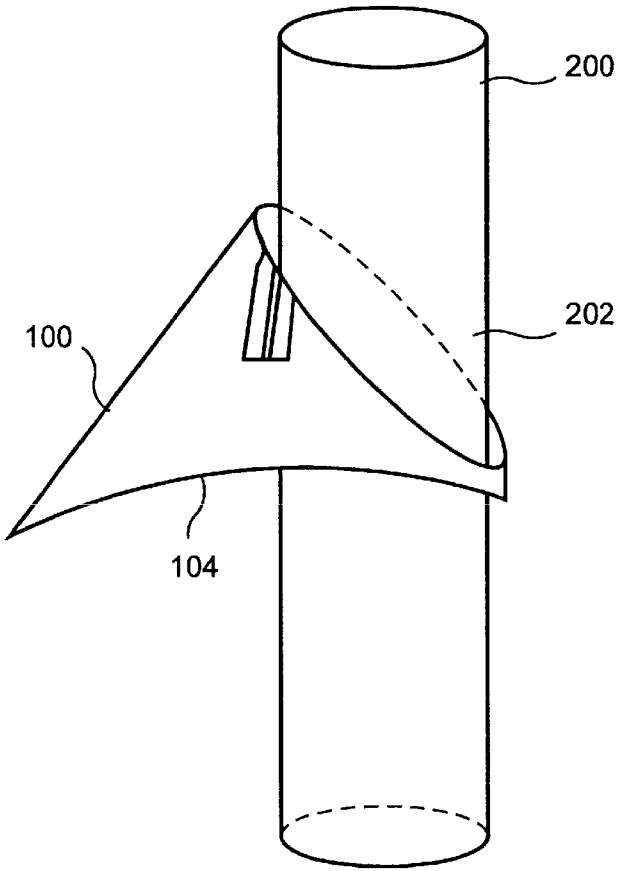
FIG. 2A PRIOR ART
FIG. 2A is a side perspective view of the film and zipper of the prior art being turned down by the forming collar of a form fill and seal apparatus.
Figure 3B:
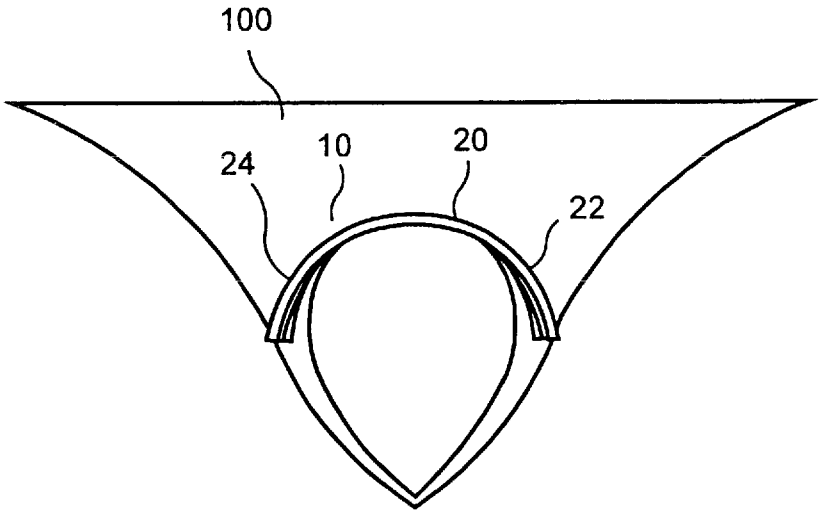
FIG. 3B is a top plan view of the film and zipper of the present invention being turned down by the forming collar of a form fill and seal apparatus.
Figure 3A:
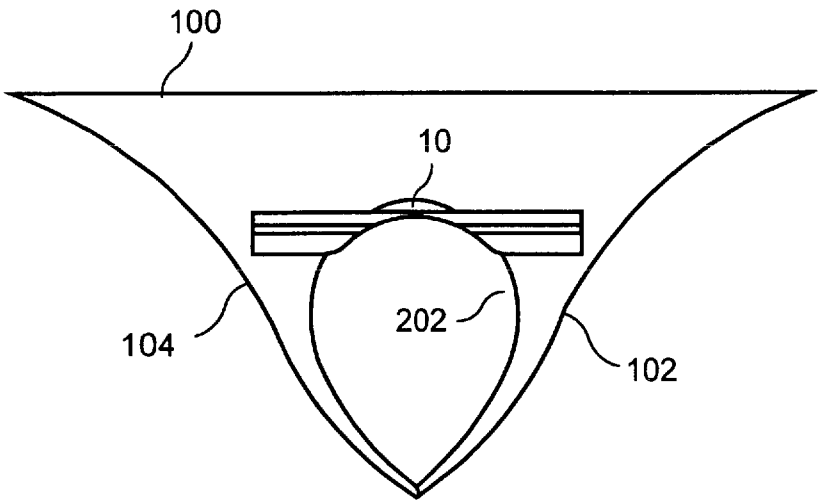
FIG. 3A PRIOR ART
FIG. 3A is a top plan view of the film and zipper of the prior art being turned down by the forming collar of a form fill and seal apparatus.

Referring now to the drawings in detail wherein like numerals indicate like elements throughout the several views, one sees in FIG. 1 that film 100, in a form fill and seal method and apparatus, travels in the direction indicated by the arrow and is laterally bounded by edges 102, 104. Zipper 10 is of the type generally known in the prior art, typically with releasably interlocking sections 12 and 14 and is transversely oriented with respect to the direction of travel of film 100. Section 12 abuts film 100. The illustrated embodiment is the single flange version where the seal is on the single flange below the profile. However, those skilled in the art will recognize that other embodiments are within the scope of the invention. Section 12 includes central area 20 (shaded) and outer areas 22, 24. The central area 20 and the outer areas 22, 24 each extend approximately one third of the length of profile 12. Outer areas 22, 24 are oriented toward edges 102, 104 of film 100. However, prior to film 100 being turned down by the forming collar 202 of the fill tube 200, central area 20 of profile 12 is secured to film 100 by typical prior art methods (such as by resistive heating or ultrasonic welding) while outer areas 22, 24 are free of attachment or securing to film 100. Therefore, when film 100 is turned down by forming collar 202 of the fill tube 200 (see FIGS. 2B and 3B) and makes the transition from flat (FIG. 1) to conforming to the diameter of the forming collar 202 of the fill tube 200, outer areas 22, 24 extend away from film 100 during this process thereby reducing the twisting and tension on zipper 10. Outer areas 22, 24 can subsequently be aligned and secured to film 100.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. In a form fill and seal method of the type including a step of turning down a film by a forming collar of a filling tube, the improvement comprising the step of, prior to said step of turning down, securing a zipper transversely to a direction of travel of the film, wherein a central area of said zipper relative to longitudinal edges of said zipper is secured to said film and longitudinal outer areas of said zipper are free of attachment to the film.

2. The improvement of claim 1 further comprising the step of securing said outer areas of said zipper to said film subsequent to the step of turning a film down by the forming collar of a filling tube.

3. The method of claim 1 wherein each of the central area and outer areas extend over approximately one third of an overall length of the zipper.

4. A film for a form fill and seal apparatus including:

a zipper transverse to a direction of travel of the film;

said zipper including a central area relative to longitudinal edges, and outer longitudinal areas, wherein said central area is secured to the film and said outer areas are free of attachment to the film prior to said film being turned down by a forming collar of a fill tube.

5. The film of claim 4 wherein subsequent to said film being turned down by the forming collar of the fill tube, said outer areas are attached to the film.

* * * * *